US010580555B2

(12) United States Patent
Ito

(10) Patent No.: US 10,580,555 B2
(45) Date of Patent: Mar. 3, 2020

(54) SUPERCONDUCTING COIL PRE-COOLING METHOD AND SUPERCONDUCTING MAGNET APPARATUS

(71) Applicant: JAPAN SUPERCONDUCTOR TECHNOLOGY INC., Hyogo (JP)

(72) Inventor: Satoshi Ito, Kobe (JP)

(73) Assignee: JAPAN SUPERCONDUCTOR TECHNOLOGY INC., Hyogo (JP)

( * ) Notice: Subject to any disclaimer, the term of this patent is extended or adjusted under 35 U.S.C. 154(b) by 108 days.

(21) Appl. No.: 15/794,560

(22) Filed: Oct. 26, 2017

(65) Prior Publication Data

US 2018/0144852 A1 May 24, 2018

(30) Foreign Application Priority Data

Nov. 24, 2016 (JP) ..... 2016-227888

(51) Int. Cl.

| | |
|---|---|
| ***H01F 6/04*** | (2006.01) |
| ***F25B 9/10*** | (2006.01) |
| ***F17C 3/08*** | (2006.01) |
| ***F25B 9/14*** | (2006.01) |
| ***H01F 6/06*** | (2006.01) |
| *F25B 25/00* | (2006.01) |

(52) U.S. Cl.

CPC ..... *H01F 6/04* (2013.01); *F17C 3/08* (2013.01); *F17C 3/085* (2013.01); *F25B 9/10* (2013.01); *F25B 9/14* (2013.01); *H01F 6/06* (2013.01); *F25B 25/005* (2013.01)

(58) Field of Classification Search

CPC .. F25D 19/006; F25B 9/10; F25B 9/14; F25B 9/145; F25B 2400/17; H01F 6/04; F17C 2221/017; F17C 3/08; F17C 3/085

See application file for complete search history.

(56) References Cited

U.S. PATENT DOCUMENTS 4,578,962 A * 4/1986 Dustmann ..... H01F 6/04 310/54
5,410,286 A * 4/1995 Herd ..... F25D 29/001 335/216

(Continued)

FOREIGN PATENT DOCUMENTS

JP 5196781 B 5/2013

*Primary Examiner* — Keith M Raymond

(74) *Attorney, Agent, or Firm* — Studebaker & Brackett PC

(57) ABSTRACT

Provided is a superconducting coil pre-cooling method for cooling a superconducting coil in a superconducting magnet apparatus including: the superconducting coil; a helium tank; a radiation shield; a vacuum case; and a refrigerator including a first cooling stage and a second cooling stage, a passage being disposed between the refrigerator and the radiation shield. The method includes: a supplying step of supplying a working medium in a gaseous state having a condensation point lower than a condensation point of nitrogen into a refrigerator surrounding tube; a cooling step of cooling the superconducting coil in a tank body by the working medium in the gaseous state that is cooled in the first cooling stage and further cooled in the second cooling stage after passing through the passage; and a discharging step of discharging the working medium that has cooled the superconducting coil in the tank body, out of the vacuum case.

5 Claims, 1 Drawing Sheet

(56) References Cited

U.S. PATENT DOCUMENTS

| | | | | |
|---|---|---|---|---|
| 5,461,873 | A * | 10/1995 | Longsworth | F25B 9/14 505/892 |
| 2006/0021355 | A1* | 2/2006 | Boesel | F25B 9/145 62/51.1 |
| 2006/0064989 | A1 | 3/2006 | Roth | |
| 2007/0245749 | A1 | 10/2007 | Atkins et al. | |
| 2011/0219785 | A1* | 9/2011 | Black | F17C 13/007 62/3.1 |
| 2012/0242335 | A1* | 9/2012 | Schett | G01R 33/3403 324/318 |
| 2015/0047377 | A1* | 2/2015 | Hamasaki | F25B 9/145 62/115 |

* cited by examiner

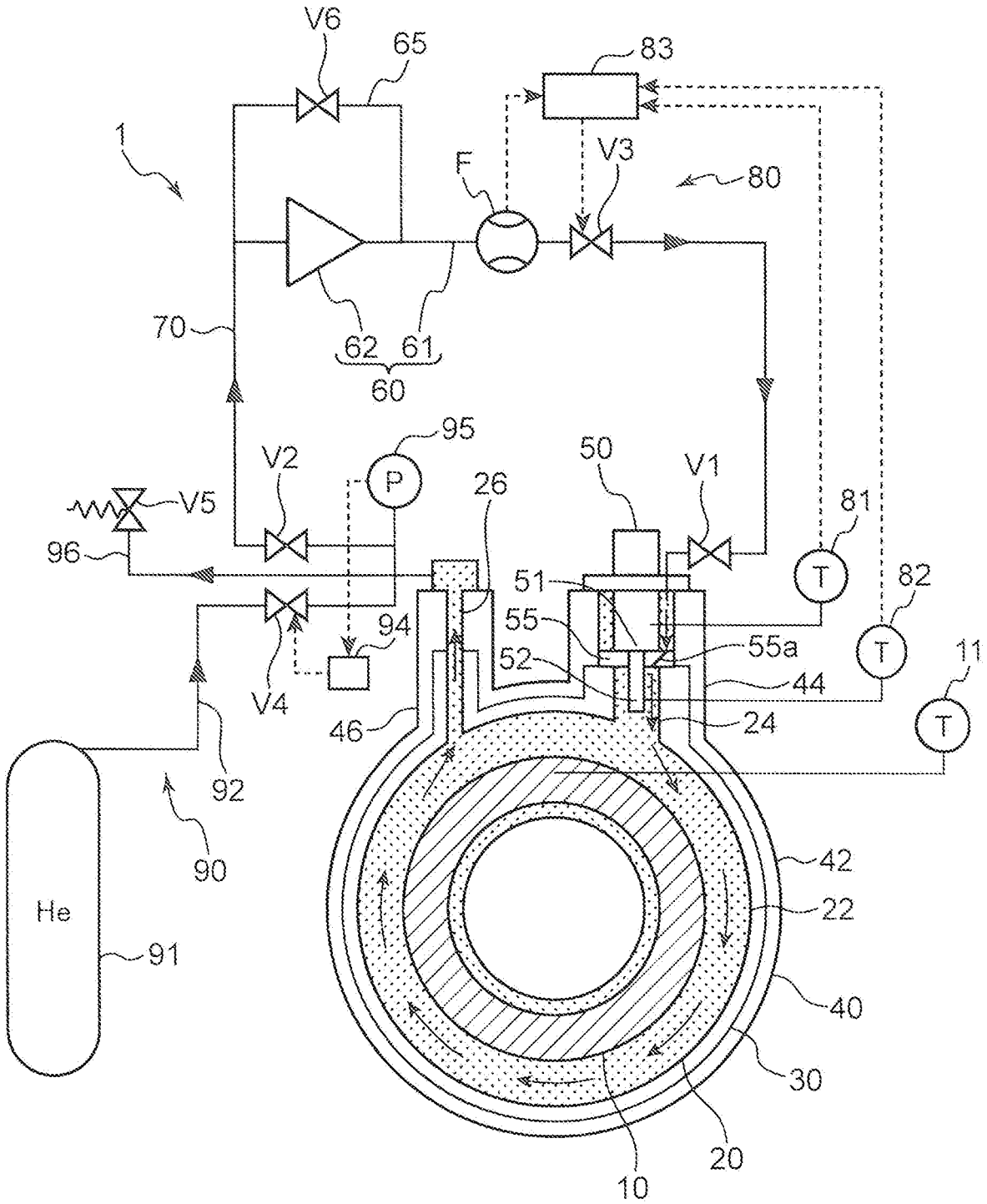
V6
65
83
1
F
V3
80
70
62
61
60
95
V2
P
26
50
V1
V5
81
96
51
T
82
94
55
55a
52
T
11
V4
44
46
24
T
92
90
42
He
22
91
40
30
20
10

SUPERCONDUCTING COIL PRE-COOLING METHOD AND SUPERCONDUCTING MAGNET APPARATUS

TECHNICAL FIELD

This invention relates to a method for pre-cooling a superconducting coil in a superconducting magnet apparatus.

BACKGROUND ART

Hitherto, a superconducting magnet apparatus including a superconducting coil, a helium tank, a radiation shield, a vacuum case, and a refrigerator is known as a superconducting magnet apparatus configured to generate a high magnetic field by using a superconducting coil in a superconducting state. The helium tank houses the superconducting coil and liquid helium. The radiation shield houses the helium tank. The vacuum case houses the radiation shield. The refrigerator includes a first cooling stage that is thermally connected to the radiation shield to cool the radiation shield and a second cooling stage for condensing helium gas in the helium tank. The helium tank includes a tank body that houses the superconducting coil, a refrigerator surrounding tube extending upward from the tank body and surrounding the refrigerator, and a communicating tube which extends upward from the tank body and through which an inside of the tank body and an outside communicate with each other. The vacuum case includes a first tubular portion that surrounds the refrigerator surrounding tube, and a second tubular portion that surrounds the communicating tube.

The superconducting coil in the superconducting magnet apparatus as described above is pre-cooled to a temperature at which the superconducting coil enters a superconducting state by a method described in Japanese Patent No. 5196781 (hereinafter referred to as "Patent Literature 1"), for example. In the pre-cooling method described in Patent Literature 1, liquid nitrogen is first supplied into the tank body through the communicating tube, for example, at normal temperature (for example, room temperature) and the superconducting coil is cooled by the liquid nitrogen to a first temperature (for example, 77 K). Then, the liquid helium is supplied into the tank body. By the liquid helium, the superconducting coil is cooled to a second temperature, that is, a temperature (for example, 4 K) at which the superconducting coil enters a superconducting state. Then, the tank body is filled with the liquid helium by an amount required for the superconducting coil to be immersed in the liquid helium. The superconducting magnet apparatus shifts to a steady-state operation after the superconducting coil is pre-cooled in this way.

In the method for pre-cooling the superconducting coil in the superconducting magnet apparatus described in Patent Literature 1, a large amount of liquid helium is consumed to cool the superconducting coil until the superconducting coil enters a superconducting state after the superconducting coil is cooled by the liquid nitrogen.

SUMMARY OF INVENTION

It is an object of this invention to provide a superconducting coil pre-cooling method and a superconducting magnet apparatus, which are capable of reducing the amount of liquid helium needed to cool a superconducting coil until the superconducting coil enters a superconducting state.

In order to solve the problem, the inventors of this invention have found out that a structure including a helium tank including a refrigerator surrounding tube and a communicating tube, and a refrigerator held by the refrigerator surrounding tube can be used to effectively cool the superconducting coil by a working medium in a gaseous state (helium gas, hydrogen gas, and the like) having a condensation point lower than the condensation point of nitrogen by supplying the working medium in the gaseous state from a refrigerator surrounding tube. Specifically, although a first cooling stage of the refrigerator and a radiation shield are thermally connected, a small passage through which a lead and the like of a temperature sensor mounted on the refrigerator is disposed between the first cooling stage and the radiation shield. Thus, a flow in which the working medium passes through the passage, a tank body, and a communicating tube in the stated order to be discharged out of a vacuum case is created by supplying the working medium in the gaseous state into the refrigerator surrounding tube. The working medium in the gaseous state supplied into the refrigerator surrounding tube is cooled in each cooling stage of the refrigerator in a process of flowing toward the tank body through the passage. Thus, the superconducting coil is cooled effectively and to a temperature lower than the condensation point of nitrogen in the tank body by the working medium. As a result, the amount of liquid helium needed to cool the superconducting coil can be reduced by supplying the working medium in the gaseous state having a condensation point lower than the condensation point of nitrogen into the refrigerator surrounding tube.

This invention has been made from the above-mentioned viewpoint. Specifically, a superconducting coil pre-cooling method according to an aspect of this invention is a method for cooling a superconducting coil in a superconducting magnet apparatus until the superconducting coil enters a superconducting state, the superconducting magnet apparatus including: the superconducting coil; a helium tank that houses the superconducting coil and liquid helium; a radiation shield that houses the helium tank; a vacuum case that houses the radiation shield; and a refrigerator having a first cooling stage thermally connected to the radiation shield, and a second cooling stage configured to condense a working medium in the helium tank, the helium tank including: a tank body that houses the superconducting coil; a refrigerator surrounding tube extending upward from the tank body and surrounding the refrigerator; and a communicating tube, which extends upward from the tank body and through which an inside of the tank body and an outside communicate with each other, the vacuum case including: a first tubular portion that surrounds the refrigerator surrounding tube; and a second tubular portion that surrounds the communicating tube, a passage being disposed between the refrigerator and the radiation shield, the method including: a supplying step of supplying a working medium in a gaseous state having a condensation point lower than a condensation point of nitrogen into the refrigerator surrounding tube; a cooling step of cooling the superconducting coil in the tank body by the working medium in the gaseous state that is cooled in the first cooling stage and further cooled in the second cooling stage after passing through the passage; and a discharging step of discharging the working medium that has cooled the superconducting coil in the tank body, out of the vacuum case through the communicating tube.

A superconducting magnet apparatus according to an aspect of this invention is a superconducting magnet apparatus including: a superconducting coil; a helium tank that houses the superconducting coil and liquid helium; a radiation shield that houses the helium tank; a vacuum case that houses the radiation shield; a refrigerator having a first cooling stage thermally connected to the radiation shield, and a second cooling stage configured to condense a working medium in the helium tank; and a supply unit configured to supply a working medium in a gaseous state having a condensation point lower than a condensation point of nitrogen into the helium tank, wherein the helium tank includes: a tank body that houses the superconducting coil; a refrigerator surrounding tube extending upward from the tank body and surrounding the refrigerator; and a communicating tube, which extends upward from the tank body and through which an inside of the tank body and an outside communicate with each other, the vacuum case includes: a first tubular portion that surrounds the refrigerator surrounding tube; and a second tubular portion that surrounds the communicating tube, a passage is disposed between the refrigerator and the radiation shield, and the supply unit includes: a supply flow path configured to supply the working medium into the refrigerator surrounding tube; and a pump provided in the supply flow path and configured to create a flow in which the working medium flows from the inside of the refrigerator surrounding tube into the tank body through the passage while coming into contact with the first cooling stage and the second cooling stage and is discharged out of the vacuum case through the communicating tube after cooling the superconducting coil.

BRIEF DESCRIPTION OF DRAWINGS

The FIGURE is a view illustrating the overview of a superconducting magnet apparatus according to one embodiment of this invention.

DESCRIPTION OF EMBODIMENTS

A superconducting magnet apparatus 1 according to one embodiment of this invention is described with reference to the FIGURE.

As illustrated in the FIGURE, the superconducting magnet apparatus 1 includes a superconducting coil 10, a helium tank 20, a radiation shield 30, a vacuum case 40, a refrigerator 50, a supply unit 60, a return flow path 70, a flow rate adjustment unit 80, and a replenishing unit 90.

The superconducting coil 10 is a coil obtained by winding a wire rod made of a superconductor (superconducting material) around a reel.

The helium tank 20 houses the superconducting coil 10 and liquid helium. The helium tank 20 houses the superconducting coil 10 in a posture in which the central axis of the superconducting coil 10 is horizontal. Specifically, the helium tank 20 includes a tank body 22 having a shape encompassing the superconducting coil 10, a refrigerator surrounding tube 24 extending upward from an upper portion of the tank body 22 and surrounding the refrigerator 50, and a communicating tube 26 which extends upward from the upper portion of the tank body 22 and through which the inside of the tank body 22 and the outside communicate with each other. The tubes 24 and 26 are connected to the upper portion of the tank body 22 in postures orthogonal to the central axis of the tank body 22 and at positions separated from each other.

The radiation shield 30 houses the helium tank 20. More specifically, the radiation shield 30 has a shape covering the tank body 22, a lower portion of the refrigerator surrounding tube 24, and a lower portion of the communicating tube 26. The radiation shield 30 is made of aluminum. The radiation shield 30 is configured to suppress heat penetration from the outside of the radiation shield 30 to the helium tank 20.

The vacuum case 40 has a shape to house the radiation shield 30. The inside of the vacuum case 40 is maintained in a vacuum state. As a result, heat penetration to the inside of the vacuum case 40 is suppressed. The vacuum case 40 mainly includes a case body 42 that houses the tank body 22, a first tubular portion 44 that surrounds the refrigerator surrounding tube 24, and a second tubular portion 46 that surrounds the communicating tube 26.

The refrigerator 50 is removably attached to the refrigerator surrounding tube 24 and the first tubular portion 44. The refrigerator 50 includes a first cooling stage 51 and a second cooling stage 52. The first cooling stage 51 is thermally connected to the radiation shield 30 through a heat conductive member 55 made of a material (copper and the like) having high thermal conductivity. A passage **55*a* for allowing a lead and the like of a temperature sensor mounted on the refrigerator 50 to pass therethrough is disposed between the first cooling stage 51 and the heat conductive member 55. The second cooling stage 52 is located at a lower portion of the refrigerator surrounding tube 24 or inside the tank body 22. The second cooling stage 52 is configured to recondense helium that has vaporized in the tank body 22 in a steady-state operation of the superconducting magnet apparatus 1. When the refrigerator 50 is driven, the temperature of the first cooling stage 51 (the temperature of the radiation shield 30) becomes about 30 K to 60 K and the temperature of the second cooling stage 52** becomes about 4 K.

The supply unit 60 is configured to supply a working medium in a gaseous state (helium gas, hydrogen gas, and the like) having a condensation point lower than the condensation point of nitrogen into the helium tank 20. In this embodiment, helium gas is used as the working medium in the gaseous state. The supply unit 60 includes a supply flow path 61 and a pump 62 provided in the supply flow path 61.

The supply flow path 61 is a flow path configured to supply helium gas from the outside of the vacuum case 40 into the refrigerator surrounding tube 24. An end portion of the supply flow path 61 on the downstream side thereof is located above the first cooling stage 51 in the refrigerator surrounding tube 24. A first on-off valve V1 is provided in the supply flow path 61.

The pump 62 forms a flow of helium gas as indicated by the arrows in the helium tank 20 in the FIGURE, that is, a flow of helium gas flowing through the passage **55*a* to the refrigerator surrounding tube 24, the tank body 22, and the communicating tube 26 in the stated order toward the outside of the vacuum case 40. In the process of flowing from the inside of the refrigerator surrounding tube 24 into the tank body 22 through the passage 55*a*, the helium gas comes into contact with the first cooling stage 51 and the second cooling stage 52, thereby being cooled by the cooling stages 51 and 52, and comes into contact with the superconducting coil 10 in the tank body 22 to cool the superconducting coil 10**.

The return flow path 70 is a flow path configured to return the helium gas discharged out of the vacuum case 40 through the communicating tube 26 to the supply flow path 61. That is, an end portion of the return flow path 70 on the upstream side thereof is connected to an upper end portion (port) of the communicating tube 26, and an end portion of the return flow path 70 on the downstream side thereof is connected to an end portion of the supply flow path 61 on the upstream side thereof. As a result, the helium gas discharged out of the vacuum case 40 through the communicating tube 26 is supplied into the refrigerator surrounding tube 24 again by the pump 62 through the supply flow path 61. A second on-off valve V2 is provided in the return flow path 70.

The flow rate adjustment unit 80 is configured to adjust the flow rate of the helium gas to be supplied into the refrigerator surrounding tube 24. In this embodiment, the flow rate adjustment unit 80 includes a flow rate adjustment valve V3 provided in the supply flow path 61, and an opening degree adjustment unit 83 configured to adjust the opening degree of the flow rate adjustment valve V3. The flow rate adjustment valve V3 is configured to adjust the flow rate of the helium gas flowing through the supply flow path 61. The opening degree adjustment unit 83 is configured to adjust the opening degree of the flow rate adjustment valve V3 so that the flow rate of the helium gas to be supplied into the refrigerator surrounding tube 24 is a set flow rate that is set in accordance with the temperature of the refrigerator 50 (the refrigeration capacity of the refrigerator 50).

The temperature of the refrigerator 50 is detected by a temperature sensor 81 mounted on the first cooling stage 51 and a temperature sensor 82 mounted on the second cooling stage 52, and the flow rate of the helium gas flowing through the supply flow path 61 is detected by a flow rate sensor F provided in a part in the supply flow path 61 that is located on the upstream side of a part in which the flow rate adjustment valve V3 is provided.

The replenishing unit 90 is configured to replenish the return flow path 70 with helium gas when the amount of helium gas supplied into the refrigerator surrounding tube 24 (in this embodiment, the circulating volume of the helium gas circulating through the return flow path 70, the supply flow path 61, and the helium tank 20) is insufficient. The replenishing unit 90 includes a storage vessel 91 that stores the helium gas, a replenishment flow path 92 connecting the storage vessel 91 and the return flow path 70 to each other, a replenishment valve V4 provided in the replenishment flow path 92, and a replenishment valve adjustment unit 94 configured to adjust the opening degree of the replenishment valve V4. When the pressure in the helium tank 20 falls below a threshold value, the replenishment valve adjustment unit 94 opens the replenishment valve V4 so that the pressure in the helium tank 20 becomes equal to or higher than the threshold value. The threshold value is set to a value which enables the flow rate adjustment unit 80 to maintain the flow rate of the helium gas supplied into the refrigerator surrounding tube 24 at the set flow rate. The pressure in the helium tank 20 is detected by a pressure sensor 95 provided in the return flow path 70. When a pressure regulator is attached to the storage vessel 91, the return flow path 70 may be replenished with the helium gas in the storage vessel 91 by the pressure regulator.

A discharge flow path 96 configured to discharge the helium gas, which is discharged from the communicating tube 26, to the outside is provided in the return flow path 70. A safety valve V5 configured to open when the pressure of the helium tank 20 becomes equal to or higher than a reference value is provided in the discharge flow path 96.

Next, a method for cooling the superconducting coil 10 is described. The method for pre-cooling the superconducting coil 10 includes a supplying step of supplying the helium gas into the refrigerator surrounding tube 24, a cooling step of cooling the superconducting coil 10 by the helium gas, and a discharging step of discharging the helium gas from the helium tank 20. Before the pre-cooling method, it is preferred that liquid nitrogen be supplied into the tank body 22 through the communicating tube 26 and the superconducting coil 10 be cooled to about 77 K by the liquid nitrogen. However, cooling of the superconducting coil 10 by the liquid nitrogen can be omitted.

In the supplying step, the helium gas is supplied into the refrigerator surrounding tube 24 through the supply flow path 61. Specifically, the first on-off valve V1, the second on-off valve V2, and the flow rate adjustment valve V3 are opened and the pump 62 is driven.

As a result, a flow in which the helium gas flows through the passage 55*a* in the refrigerator surrounding tube 24 toward the tank body 22 is formed. This corresponds to the cooling step. That is, in the cooling step, the superconducting coil 10 is cooled in the tank body 22 by the helium gas that is cooled in the first cooling stage 51 and is further cooled in the second cooling stage 52 after passing through the passage 55*a*. Specifically, in the cooling step, the helium gas cooled in the cooling stages 51 and 52 flows downward in the tank body 22 because the specific gravity thereof is larger than the specific gravity of other helium gas in the helium tank 20.

The helium gas that has cooled the superconducting coil 10 flows toward the outside of the vacuum case 40 through the communicating tube 26 above the tank body 22 because the specific gravity thereof decreases due to temperature rising. This corresponds to the discharging step.

In this embodiment, the helium gas discharged out of the vacuum case 40 through the communicating tube 26 is sucked into the pump 62 through the return flow path 70, and is supplied into the refrigerator surrounding tube 24 again through the supply flow path 61.

In the supplying step, the working medium having a set flow rate that is set in accordance with the temperature of the refrigerator 50 is returned to the refrigerator surrounding tube 24. Specifically, the opening degree of the flow rate adjustment valve V3 is adjusted by the opening degree adjustment unit 83 so that a detected value of the flow rate sensor F is the set flow rate.

As the cooling of the superconducting coil 10 progresses by the helium gas circulating through the return flow path 70, the supply flow path 61, and the helium tank 20 in the stated order as described above, the density of the helium gas gradually increases (the volume decreases), and hence the pressure in the helium tank 20 (the detected value of the pressure sensor 95) starts to decrease. When the pressure in the helium tank 20 falls below a threshold value, the return flow path 70 is replenished with helium gas from the storage vessel 91 until the pressure becomes equal to or higher than the threshold value.

The helium gas is discharged from the discharge flow path 96 when the pressure in the helium tank 20 becomes equal to or higher than a reference value during the cooling of the superconducting coil 10.

As described above, in the method for pre-cooling the superconducting coil 10 of this embodiment, the helium gas supplied into the refrigerator surrounding tube 24 in the supplying step is cooled in the cooling stages 51 and 52 of the refrigerator 50 in the process of flowing through the passage 55*a* toward the inside of the tank body 22. Therefore, the superconducting coil 10 is effectively cooled in the tank body 22 by the helium gas. The helium gas has a condensation point lower than the condensation point of nitrogen, and hence the superconducting coil 10 is cooled to a temperature equal to or lower than a temperature (about 77 K) at which the superconducting coil 10 can be cooled by liquid nitrogen. As a result, the amount of liquid helium needed to cool the superconducting coil 10 until the superconducting coil 10 enters a superconducting state is reduced.

The cooling step may be continued until the temperature of the superconducting coil 10 becomes about 4 K, or may be continued until the temperature of the superconducting coil 10 becomes about 20 K, for example, and then the liquid helium may be supplied into the tank body 22 through the communicating tube 26 so that the superconducting coil 10 is cooled by the liquid helium. In either case, the amount of liquid helium needed to cool the superconducting coil 10 is reduced. The temperature of the superconducting coil 10 is detected by a temperature sensor 11 mounted on the superconducting coil 10.

In this embodiment, the helium gas circulates through the return flow path 70, the supply flow path 61, and the helium tank 20, and hence the amount of the helium gas supplied into the helium tank 20 is reduced.

In the supplying step, the working medium having a set flow rate that is set in accordance with the temperature of the refrigerator 50 is returned to the refrigerator surrounding tube 24, and hence the superconducting coil 10 is effectively cooled by the helium gas. Specifically, helium gas having a flow rate lower than the set flow rate is prevented from being supplied to the refrigerator surrounding tube 24 such that the cooling of the superconducting coil 10 becomes insufficient (the pre-cooling time of the superconducting coil 10 becomes longer), and helium gas having a flow rate higher than the set flow rate is prevented from being supplied to the refrigerator surrounding tube 24 such that the cooling of the helium gas in the refrigerator 50 becomes insufficient (the temperature of the superconducting coil 10 rises).

The embodiment disclosed herein is to be regarded as illustrative and nonrestrictive in all respects. The scope of this invention is described by the claims and not by the description of the embodiment, and includes equivalents of the claims and all the changes in the scope thereof.

For example, hydrogen gas may be used instead of helium gas as the working medium in the gaseous state. In this case, it is preferred that the superconducting coil 10 be cooled by hydrogen gas until the temperature thereof becomes about 20 K, for example, and then be cooled by liquid helium in the cooling step. The amount of liquid helium needed to cool the superconducting coil 10 is also reduced in this case.

The configuration of the flow rate adjustment unit 80 is not limited to the example of the embodiment. The flow rate adjustment unit 80 may include a rotational speed adjustment unit configured to adjust the rotational speed of the pump 62 in accordance with the temperature of the refrigerator 50. Alternatively, a bypass flow path 65 configured to bypass the pump 62 may be provided in the supply flow path 61, and the opening degree adjustment unit 83 may adjust the opening degree of a bypass valve V6 provided in the bypass flow path 65 in accordance with the temperature of the refrigerator 50.

The return flow path 70 may be omitted. That is, the working medium in the gaseous state is not necessarily required to circulate through the return flow path 70, the supply flow path 61, and the helium tank 20.

The embodiment described above includes the following invention.

A superconducting coil pre-cooling method according to this embodiment is a method in which a superconducting coil in a superconducting magnet apparatus is cooled until the superconducting coil enters a superconducting state, the superconducting magnet apparatus including: the superconducting coil; a helium tank that houses the superconducting coil and liquid helium; a radiation shield that houses the helium tank; a vacuum case that houses the radiation shield; and a refrigerator having a first cooling stage thermally connected to the radiation shield, and a second cooling stage configured to condense a working medium in the helium tank, the helium tank including: a tank body that houses the superconducting coil; a refrigerator surrounding tube extending upward from the tank body and surrounding the refrigerator; and a communicating tube, which extends upward from the tank body and through which an inside of the tank body and an outside communicate with each other, the vacuum case including: a first tubular portion that surrounds the refrigerator surrounding tube; and a second tubular portion that surrounds the communicating tube, a passage being disposed between the refrigerator and the radiation shield, the method including: a supplying step of supplying a working medium in a gaseous state having a condensation point lower than a condensation point of nitrogen into the refrigerator surrounding tube; a cooling step of cooling the superconducting coil in the tank body by the working medium in the gaseous state that is cooled in the first cooling stage and further cooled in the second cooling stage after passing through the passage; and a discharging step of discharging the working medium that has cooled the superconducting coil in the tank body, out of the vacuum case through the communicating tube.

In the superconducting coil pre-cooling method, the working medium in the gaseous state supplied into the refrigerator surrounding tube in the supplying step is cooled in each cooling stage of the refrigerator in the process of flowing toward the inside of the tank body through the passage. Thus, the superconducting coil is effectively cooled in the tank body by the working medium in the gaseous state. A medium (helium gas, hydrogen gas, and the like) having a condensation point lower than the condensation point of nitrogen is used as the working medium, and hence the superconducting coil is cooled to a temperature equal to or lower than a temperature (about 77 K) at which the superconducting coil is cooled by liquid nitrogen. As a result, the amount of liquid helium needed to cool the superconducting coil until the superconducting coil enters a superconducting state is reduced.

The working medium cooled in each cooling stage in the cooling step flows downward in the tank body because the specific gravity of the working medium becomes larger than the specific gravity of other working mediums in the helium tank. The temperature of the working medium rises by cooling the superconducting coil. As a result, the specific gravity of the working medium decreases, and hence the working medium flows toward the outside of the vacuum case through the communicating tube above the tank body.

It is preferred that, in the supplying step, the working medium discharged out of the vacuum case in the discharging step be supplied to the refrigerator surrounding tube.

In this way, the working medium circulates through a circulation flow path including the refrigerator surrounding tube, the tank body, and the communicating tube, and hence the amount of the working medium supplied to the helium tank is reduced.

It is preferred that, in the supplying step, the working medium having a set flow rate that is set in accordance with a temperature of the refrigerator be returned to the refrigerator surrounding tube.

In this way, the superconducting coil is effectively cooled by the working medium in the gaseous state. Specifically, the case in which the cooling of the superconducting coil becomes insufficient (the pre-cooling time of the superconducting coil becomes longer) due to the working medium having a flow rate lower than the set flow rate being supplied to the refrigerator surrounding tube, and the case in which the cooling of the working medium in the refrigerator becomes insufficient (the temperature of the superconducting coil rises) due to the working medium having a flow rate higher than the set flow rate being supplied to the refrigerator surrounding tube are suppressed.

A superconducting magnet apparatus according to this embodiment is a superconducting magnet apparatus including: a superconducting coil; a helium tank that houses the superconducting coil and liquid helium; a radiation shield that houses the helium tank; a vacuum case that houses the radiation shield; a refrigerator having a first cooling stage thermally connected to the radiation shield, and a second cooling stage configured to condense a working medium in the helium tank; and a supply unit configured to supply a working medium in a gaseous state having a condensation point lower than a condensation point of nitrogen into the helium tank, wherein the helium tank includes: a tank body that houses the superconducting coil; a refrigerator surrounding tube extending upward from the tank body and surrounding the refrigerator; and a communicating tube, which extends upward from the tank body and through which an inside of the tank body and an outside communicate with each other, the vacuum case includes: a first tubular portion that surrounds the refrigerator surrounding tube; and a second tubular portion that surrounds the communicating tube, a passage is disposed between the refrigerator and the radiation shield, and the supply unit includes: a supply flow path configured to supply the working medium into the refrigerator surrounding tube; and a pump provided in the supply flow path and configured to create a flow in which the working medium flows from the inside of the refrigerator surrounding tube into the tank body through the passage while coming into contact with the first cooling stage and the second cooling stage and is discharged out of the vacuum case through the communicating tube after cooling the superconducting coil.

Also in the superconducting magnet apparatus, the superconducting coil is effectively cooled by the working medium in the gaseous state supplied into the refrigerator surrounding tube through the supply flow path. As a result, the amount of liquid helium needed to cool the superconducting coil until the superconducting coil enters the superconducting state is reduced.

It is preferred that the superconducting magnet apparatus further include a return flow path configured to return the working medium discharged out of the vacuum case through the communicating tube, to the supply flow path.

In this way, the working medium circulates through the helium tank, the return flow path, and the supply flow path in the stated order, and hence the amount of the working medium used to cool the superconducting coil is reduced.

In that case, it is preferred that the superconducting magnet apparatus further include a flow rate adjustment unit configured to adjust a flow rate of the working medium to be supplied into the refrigerator surrounding tube so that the working medium having a set flow rate that is set in accordance with a temperature of the refrigerator is supplied into the refrigerator surrounding tube.

In this way, the superconducting coil is effectively cooled by the working medium in the gaseous state. Specifically, the case in which the cooling of the superconducting coil becomes insufficient (the pre-cooling time of the superconducting coil becomes longer) due to the working medium having a flow rate lower than the set flow rate being supplied to the refrigerator surrounding tube, and the case in which the cooling of the working medium in the refrigerator becomes insufficient (the temperature of the superconducting coil rises) due to the working medium having a flow rate higher than the set flow rate being supplied to the refrigerator surrounding tube are suppressed.

In that case, it is preferred that the superconducting magnet apparatus further include a replenishing unit capable of replenishing the return flow path with a working medium in a gaseous state.

In this way, the replenishing unit replenishes the return flow path with the working medium in the gaseous state to effectively continue the cooling of the superconducting coil when the volume of the working medium in the gaseous state decreases as the cooling of the superconducting coil progresses (the temperature of the working medium in the gaseous state decreases), that is, when the circulating volume of the working medium in the gaseous state circulating through the return flow path, the supply flow path, and the helium tank decreases. The return flow path has a relatively low pressure, which facilitates the replenishment of the working medium in the gaseous state.

Specifically, it is preferred that the replenishing unit be configured to replenish the return flow path with the working medium in the gaseous state when a pressure of any one of the helium tank and the return flow path falls below a threshold value that enables the flow rate adjustment unit to maintain a flow rate of the working medium in the gaseous state to be supplied into the refrigerator surrounding tube at the set flow rate so that the pressure becomes equal to or higher than the threshold value.

In this way, the flow rate of the working medium in the gaseous state to be supplied into the refrigerator surrounding tube can be maintained at the set flow rate, which enables a more effective cooling of the superconducting coil.

This application is based on Japanese Patent application No. 2016-227888 filed in Japan Patent Office on Nov. 24, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A superconducting magnet apparatus, comprising:

a superconducting coil;

a helium tank that houses the superconducting coil and liquid helium in a posture in which the central axis of the superconducting coil is horizontal;

a radiation shield that houses the helium tank;

a vacuum case that houses the radiation shield;

a refrigerator having a first cooling stage thermally connected to the radiation shield, and a second cooling stage configured to condense a working medium in the helium tank; and a supply unit configured to supply a working medium in a gaseous state having a condensation point lower than a condensation point of nitrogen into the helium tank, wherein the helium tank includes:

a tank body that houses the superconducting coil and has a shape encompassing the superconducting coil;

a refrigerator surrounding tube extending upward from an upper portion of the tank body and surrounding the refrigerator; and a communicating tube which extends upward from the upper portion of the tank body and through which an inside of the tank body and an outside communicate with each other, the vacuum case includes:

a first tubular portion that surrounds the refrigerator surrounding tube; and a second tubular portion that surrounds the communicating tube, a passage is disposed between the refrigerator and the radiation shield, and the supply unit includes:

a supply flow path configured to supply the working medium in the gaseous state into the refrigerator surrounding tube; and a pump provided in the supply flow path and configured to create a flow in which the working medium in the gaseous state flows from the inside of the refrigerator surrounding tube into the tank body through the passage while coming into contact with the first cooling stage and the second cooling stage, flows downward between the tank body and the superconducting coil to pre-cool the super conducting coil until the superconducting coil enters a superconducting state, and flows upward between the tank body and the superconducting coil to be discharged out of the vacuum case through the communicating tube after cooling the superconducting coil.

2. The superconducting magnet apparatus according to claim 1, further comprising a return flow path configured to return the working medium discharged out of the vacuum case through the communicating tube, to the supply flow path.

3. The superconducting magnet apparatus according to claim 2, further comprising a flow rate adjustment valve configured to adjust a flow rate of the working medium to be supplied into the refrigerator surrounding tube so that the working medium having a set flow rate that is set based on a temperature of the refrigerator is supplied into the refrigerator surrounding tube.

4. The superconducting magnet apparatus according to claim 3, further comprising a replenishing unit comprising a storage vessel configured to store the helium gas, a replenishment flow path connecting the storage vessel and the return flow path to each other, and a replenishment valve provided in the replenishment flow path, the replenishing unit being capable of replenishing the return flow path with a working medium in a gaseous state.

5. The superconducting magnet apparatus according to claim 4, wherein the replenishing unit is configured to replenish, when a pressure in the helium tank or the return flow path falls below a threshold value that enables the flow rate adjustment valve to maintain a flow rate of the working medium in the gaseous state supplied into the refrigerator surrounding tube at the set flow rate, the return flow path with the working medium in the gaseous state so that the pressure becomes equal to or higher than the threshold value.

* * * * *